US009770631B2

(12) United States Patent
Tarrant

(10) Patent No.: US 9,770,631 B2
(45) Date of Patent: Sep. 26, 2017

(54) SYSTEMS, METHODS AND DEVICES FOR TENSIONING RACKET STRING

(71) Applicant: John C. Tarrant, Camarillo, CA (US)

(72) Inventor: John C. Tarrant, Camarillo, CA (US)

( * ) Notice: Subject to any disclaimer, the term of this patent is extended or adjusted under 35 U.S.C. 154(b) by 105 days.

(21) Appl. No.: 15/002,318

(22) Filed: Jan. 20, 2016

(65) Prior Publication Data

US 2017/0203164 A1 Jul. 20, 2017

(51) Int. Cl.
*A63B 51/14* (2006.01)

(52) U.S. Cl.
CPC ..... *A63B 51/14* (2013.01)

(58) Field of Classification Search
CPC ..... A63B 51/00; A63B 51/14; A63B 51/16
See application file for complete search history.

(56) References Cited

U.S. PATENT DOCUMENTS 1,943,400 A * 1/1934 Fischmann ..... A63B 51/14 473/556
1,962,865 A * 6/1934 Goodhall ..... A63B 51/14 473/556
4,373,721 A * 2/1983 Ray ..... A63B 51/14 254/213
5,269,515 A * 12/1993 Chu ..... A63B 51/14 473/556
5,338,028 A * 8/1994 Sung ..... A63B 51/14 473/556
5,590,877 A * 1/1997 Ho ..... A63B 51/14 473/556
8,206,249 B1 * 6/2012 Wise ..... A63B 51/14 473/557
2015/0133243 A1 * 5/2015 Zdrazila ..... A63B 51/14 473/556

(Continued)

OTHER PUBLICATIONS

Gamma, X-Stringer X-6 Stringing Machine Owner's Manual, May 2004, pp. 1-15, Issue 1, Pittsburgh, Pennsylvania.

(Continued)

*Primary Examiner* — Raleigh W Chiu
(74) *Attorney, Agent, or Firm* — Sheppard, Mullin, Richter & Hampton LLP

(57) ABSTRACT

A dual tension racket string tensioning system and methods for implementing the same are disclosed. Embodiments of the disclosure include a tensioner equipped with two or more receptacles to releasably grip two or more portions of string simultaneously, and simultaneously apply a force at each portion of the string held in the receptacles. Embodiments of the present disclosure include a turntable rotatably coupled to a base structure, a mounting support adjustably coupled to the turntable (the mounting support configured to receive and hold a racket), and a dual tensioner, as disclosed herein, coupled with the base and operable to apply force (1) at a first portion of the string via the first receptacle; and (2) at a second portion of the string via the second receptacle. Some embodiments further include a stationary dual-string clamp. Further embodiments include a gear dial for fine tuning the force applied to the string portions. And still further embodiments employ a frequency meter to measure the frequency/pitch/tension of individual string segments throughout the stringing process.

21 Claims, 8 Drawing Sheets

(56) References Cited

U.S. PATENT DOCUMENTS

| | | | | |
|---|---|---|---|---|
| 2016/0121175 | A1* | 5/2016 | Cerf | A63B 51/14 473/555 |
| 2016/0121176 | A1* | 5/2016 | Cerf | A63B 51/14 473/557 |

OTHER PUBLICATIONS

Gamma, X-Stringer X-6FC Stringing Machine Owner's Manual, May 2004, pp. 1-18, Issue 1, Pittsburgh, Pennsylvania.
Gamma, Progression 200 Stringing Machine Owner's Manual, Jul. 2010, pp. 1-16, Issue 1, Pittsburgh, Pennsylvania.
Gamma, X-Stringer X-2 Stringing Machine Owner's Manual, Sep. 2010, pp. 1-16, Issue 2, Pittsburgh, Pennsylvania.
Prince, Prince 6000 Electronic Stringing Machine Owner's Manual, https://www.tennisexpress.com/prince_6000_en.pdf, accessed Oct. 20, 2016, pp. 1-11, Winchester, Missouri.

* cited by examiner

SYSTEMS, METHODS AND DEVICES FOR TENSIONING RACKET STRING

TECHNICAL FIELD

The present disclosure relates generally to tensioning the strings of a racket (e.g. tennis racket, squash racket, etc.), and more particularly to systems, methods, and devices that can tension multiple string segments simultaneously to enhance the uniformity of the stringbed stiffness profile, and improve the overall performance of the racket.

BACKGROUND OF THE DISCLOSURE

Rackets have been used ubiquitously for many years in sports including tennis, squash, and badminton, among others. Rackets generally include a handle for the user to grip with their hand, a shaft (also referred to as the 'neck' of the racket) connecting the handle to a hoop-shaped frame or rim (also referred to as the 'head' of the racket), and a stringbed formed from one or more strings drawn through and suspended between holes in the rim.

When used in practice—in tennis, for example—a player swings the racket in an attempt to strike an approaching ball in a manner that redirects the ball along a desired trajectory to a desired location. Many factors affect the user's ability to precisely redirect the ball along the desired trajectory using the racket. Some of these factors include: (i) the stringbed stiffness profile (ii) the tensile strength and gauge of the string material, (iii) the string pattern, (iv) the location and angle with which the ball makes contact with the stringbed, (v) the mechanical strength of the racket components (e.g. rim, handle, etc.), (vi) the size of the racket head, (vii) the structural features of the holes within the rim (or of the grommets disposed in the holes when grommets are used), and (viii) the compressive strength of the ball, among many other factors. The control of some of these factors is largely dependent on the skill level of the player, e.g., factor (iv) above. However, control of certain other factors can largely depend on the equipment and methods used to manufacture, produce and assemble the racket itself. Indeed, many devices have been developed to improve control of one or more of factors (i), (ii), (v), (vi), and (vii) above, with the goal of enhancing the overall performance and consistency of the racket. However, currently available devices still fail to provide an adequate system and/or method for precisely and accurately tensioning the strings of a racket. In particular, currently available devices used for tensioning the strings of a racket cannot effectively create a uniform and/or symmetric stringbed stiffness from one side of the racket to the other (i.e. from left to right and/or top to bottom of the stringbed).

Stringbed stiffness is a measure of the extent to which the strings of a racket deflect upon impact. The stiffness of the stringbed is directly related to a player's ability to control the trajectory and placement of a ball (e.g. a tennis ball). In particular, decreasing the stringbed stiffness can increase the amount of time that the ball actually stays in contact with the strings ("dwell time") through the arc of the player's swing, thereby allowing more energy to return to the ball on rebound. Dwell time relates to ball pocketing, and may contribute to a player's ability to produce spin on the ball. Players can often achieve more control over their shots if they are able to control the amount of spin on the ball when returning the ball to their opponent, e.g., adding top-spin to the ball can cause the ball to drop short (i.e. drop in) earlier, even when hit with additional power. Alternatively, increasing the stringbed stiffness can do just the opposite, i.e., reduce the dwell time and transfer much more of the energy to the strings and racket instead of back to the ball on rebound. Accordingly, depending on the preference of the player, increasing or decreasing the stringbed stiffness can provide significant benefits and/or drawbacks to the player's performance during a game.

For example, as described above, decreasing the stringbed stiffness allows the strings to return more energy to the ball on rebound, thereby increasing the rebound velocity of the ball. So by decreasing the stiffness of the stringbed, a player may return the ball to her opponent with more power than he or she might otherwise be able. However, because dwell time increases as stringbed stiffness decreases, some players experience added difficulty in controlling the direction and/or trajectory of the ball. In particular, because the ball remains in contact with the stringbed for a longer period of time during the arc of the player's swing (i.e. along a greater portion of the swing path), the change in the racket's position and orientation from the time the ball first contacts the stringbed to the time when the ball finally rebounds off of the stringbed increases. The timing difference can be difficult for a player to resolve in real-time, and can thus introduce additional error and inconsistency into the player's game (i.e. their performance). Even trained players find it difficult to master the various timing factors at play in a game (e.g. the consistency and speed of their swing, the timing and rotation of their body movements during a swing, the speed and angle of an approaching ball, etc.), so the added timing variability introduced by a decreased stringbed stiffness can accentuate the other timing errors the player might already be struggling to perfect. In sum, while a looser configuration can enable a player to harness more power when hitting the ball, the increase in power often comes at the expense of a decrease in control.

On the other hand, increasing the stringbed stiffness decreases dwell time and causes the stringbed to deflect less on impact with the ball. Because the ball is in contact with the stringbed for a shorter period of time over the path/arc of the player's swing, the player may more easily control the direction and/or trajectory of the ball. In particular, when the stringbed stiffness is sufficiently stiff, the time period the ball is in contact with the racket stringbed during a given hit is so short that some player's subconsciously hit the ball as though it instantaneously rebounds off the racket upon contact. Though rebound is not in fact instantaneous, the error in timing offset is nevertheless minimized as the time period the ball is in contact with the racket stringbed approaches zero (approaches an instantaneous rebound). Accordingly, because the player can better approximate the position and orientation of the racket through the arc of their swing when the ball rebounds from a stiffer stringbed, players often experience an enhanced level of control over the ball when they use stiffer stringbeds. However, as indicated above, the price paid for increased control is often a loss of power. That is, increasing the stringbed stiffness causes the racket and strings to absorb much more of the energy of impact rather than returning that energy to the ball. In sum, a tighter/stiffer stringbed configuration enables players to maintain more control when hitting the ball, but that control comes at the expense of a decrease in overall power when returning the ball to an opponent.

Because of the advantages and drawbacks of increasing or decreasing the stringbed stiffness of a racket, professional players generally develop very specific preferences with regard to stringbed stiffness. Some players are able to fine tune their ability to resolve the timing offset experienced with a looser stringbed, and therefore prefer the looser configuration to give the ball more power/velocity when returning it to an opponent. Other players are willing to give up the increased power provided by a looser stringbed in order to maintain adequate control over the ball and enhance their ability to accurately place the ball in a given location on the court. For many players, the optimal stiffness configuration will balance the benefits and drawbacks identified above to best complement the user's skill level and physical capabilities. In any case, once a player identifies the stringbed stiffness most suitable for their skillset, most players will go to great lengths to have their rackets strung to display that optimal level of stiffness. Moreover, because the stiffness from one point on the stringbed to another may differ (the collection of stiffness measures across the entire stringbed being referred to herein as the stringbed stiffness profile), players may also go to great lengths to have their rackets strung with the greatest degree of uniformity and/or symmetry as possible. Indeed, a non-uniform or asymmetric stringbed stiffness profile may cause just as much frustration for a player as having an overall (e.g. average) stringbed stiffness that is too loose or too tight.

As indicated previously, the stiffness of the stringbed at any given location on the stringbed is directly related to the combined stiffness and tension measures of the individual string segments affecting that portion of the stringbed. Because the string segments are woven together to form the stringbed, the tension in each string segment has at least some effect on the stiffness displayed at any given point on the stringbed. Thus, in order to achieve the desired stringbed stiffness profile/configuration having the uniformity and symmetry the player expects (e.g. symmetry of the stiffness gradient from the center to the edges of the racket, for example) great care is required in tensioning each length or segment of string when a racket is strung. Even slight variations or imperfections in the stringing and tensioning process can be accentuated over time and have a substantial impact on the symmetry of the stringbed stiffness profile.

When discussing the symmetry and/or uniformity of a racket's stringbed stiffness profile, it should be noted that the string segments of a racket will often be considered in pairs (e.g. a pair of complementary string segments). In particular, because a racket head is symmetric about its longitudinal axis, each string segment on the racket will generally have a complementary segment that is of the same length, runs in the same direction, and is located at an equal distance (albeit in the opposite direction) from the center-line of the racket head. Each such set of string segments is called a pair for purposes of this disclosure. To achieve a stringbed stiffness profile that is symmetric, each segment within a pair should ideally display an equal tension. However, as explained below, conventional tensioning systems have certain limitations that make it difficult to achieve such symmetry.

First, when the tensioning process is carried out with conventional devices, string segments are tensioned one-at-a-time. Accordingly, a significant amount of time elapses between tensioning a given string segment and tensioning its complement (i.e. the other string segment of the pair). Unfortunately, the string material (e.g. nylon, natural gut, etc.) itself begins to creep (i.e. slacken) almost immediately upon being tensioned. So by the time the racket tensioner begins tensioning the second segment of the pair, the first segment will have already lost some amount of tension. What's more, the rate of creep in a tensioned string changes with time, so consequently the tension disparity between two string segments can be further exacerbated as time progresses.

What makes the above issue even more complicated—especially for those skilled racket tensioners who have recognized this dilemma—is the fact that different string materials behave in different ways. That is, the various stringing materials commonly used (e.g. natural gut, synthetic gut, polyester, Kevlar, Vectran, Zyex, polyolefin, etc.) differ in their mechanical properties, and they behave differently under tension. For example, polyester strings tend to experience creep (i.e. deform permanently under the influence of a mechanical stress) at a higher rate than natural gut. This irregularity further complicates the string tensioning process for most tensioners, and can further accentuate the stringbed symmetry problems discussed above. Indeed, when conventional devices are used, string segments of a pair may vary in tension by as much as 10 pounds-force (44.48 Newtons) or more.

Second, conventional stringing devices utilize either floating dual-string clamps or stationary single-string clamps to secure string segments in place post-tensioning. Floating clamps are configured with two or more clamping mechanisms configured to hold one string in place by clamping it to an already tensioned neighboring string. That is, a floating clamp uses the structure of a neighboring string to retain the tension in a subsequently tensioned string. As their name indicates, floating clamps float or hang separate from the rest of the stringing device (unlike stationary clamps), being supported only by the string(s) they are clamped onto. One well-known problem that arises when using floating clamps is that the clamp itself rotates slightly when a second segment (the segment secured in place via clamping to the first segment) is released from the tensioning mechanism (e.g. the drop-weight, crank, etc.). In particular, because the first string segment isn't completely rigid (even once it is tensioned), it will bend slightly when it becomes subject to the forces brought on by the release of the second string segment from the tensioning mechanism (thereby rotating and/or shifting the position of the floating clamp relative to its original position). This rotation and/or shift of the floating clamp introduces additional slack and variation into both string segments. The first segment slackens because the additional force applied by the second segment accelerates the amount and rate of creep in the first segment, and the second segment slackens because the bending of the first segment translates into longitudinal relaxation of the second segment. This additional slackening gives rise to further asymmetries throughout the stringbed when using floating clamps.

Because of the problems that arise when using floating clamps, many conventional racket tensioning systems have instead employed one or more stationary single-string clamps. Stationary single-string clamps are clamps that hold just a single string at a time, but which are adjustably secured to the structure of the stringing device itself (usually the turntable) to more securely hold the string segment in place. Thus, instead of using a neighboring string segment to secure the position of a subsequently tensioned string segment (as with floating clamps), the stationary clamps use the structure of the stringing device itself to secure each string segment. Because stationary clamps provide a stronger and more rigid structure to secure the position of a tensioned string segment, the tension in the string segment is retained more effectively. However, even with the added strength provided by these stationary single-string clamps, there is still a little play (i.e. movement) observed in these conventional clamps when string segment held by these clamps are released from the tensioning mechanism. And because these clamps only hold a single string at a time (and further that slight movement in the clamp is not translated equivalently to string pairs), even conventional single-string clamps can give rise to tension inconsistencies throughout the stringbed.

Third, and with respect to conventional drop-weight tensioners in particular, the weighted component utilized in such devices cannot be adjusted with precision. More specifically, the weighted component in such devices is configured be manually moved up and down a rod and be secured in a desired position using a fastening mechanism. Of course, the position of the weighted component along the length of the rod corresponds to the amount of force that will ultimately be applied to a given string segment when the weighted component is dropped (i.e. released or allowed to fall). In conventional models, however, to move the weighted component up or down the rod the user must loosen the fastener, slide the weighted component into the desired position by hand alone, and then tighten the fastener to lock the weighted component into place. Because the weighted component moves freely along the length of the rod when unfastened, the precision with which the component is moved to the right location on the rod is only as exact as the user's ability to position it. Indeed, because of this, a user's ability to fine-tune the force applied to the string segment by making very small changes in the position of the weighted component along the rod is quite limited. As such, the imprecision of such a system gives rise to further inconsistencies and asymmetries throughout the stringbed.

These issues, as discussed, give rise to asymmetry and imprecision in the tension of individual string segments and overall stiffness profile displayed stringbed. Accordingly, there is a long-felt need for systems, methods and devices that can provide more precision and symmetry in tensioning the strings of a racket.

BRIEF SUMMARY OF THE DISCLOSURE

In view of the above drawbacks, there exists a long-felt need for racket stringing systems, methods, and devices that increases precision and symmetry when tensioning the strings of a racket.

Some embodiments of the technology disclosed herein are directed towards systems and methods for more precisely tensioning the strings of a racket by using a novel dual-tension racket stringing device. The dual tension racket stringing device in accordance with some embodiments disclosed herein may include at least two receptacles configured to grip two portions of string and apply a force to each simultaneously.

Some embodiments of the technology disclosed herein are directed towards systems and methods for more precisely tensioning the strings of a racket by using a novel stationary dual-string clamp device. The stationary dual-string clamp device in accordance with some embodiments disclosed herein include at least two receptacles configured to grip two portions of string simultaneously, and secure each such portion in place when exposed to various forces.

Some embodiments of the technology disclosed herein are directed towards systems and methods for more precisely tensioning the strings of a racket by using a novel drop-weight gear dial coupled to a drop-weight tensioning system in a manner that enables small adjustments to the position of the weighted component by rotation of the gear-dial. The gear dial, in some embodiments, employs a rack and pinion configuration coupled to the weighted component of the drop-weight tensioning system.

The dual tension racket stringing device embodiments of this disclosure may be used in accordance with one or more methods also disclosed herein to tension the string in a racket and minimize error throughout the process.

BRIEF DESCRIPTION OF THE DRAWINGS

The technology disclosed herein, in accordance with one or more various embodiments, is described in detail with reference to the following figures. These figures are provided to facilitate the reader's understanding of the disclosed technology, and are not intended to be exhaustive or to limit the disclosure to the precise forms disclosed. Indeed, the drawings in the figures are provided for purposes of illustration only, and merely depict typical or example embodiments of the disclosed technology. Furthermore, it should be noted that for clarity and ease of illustration, the elements in the figures have not necessarily been drawn to scale.

Before moving on to a more detailed description of these figures, it should be noted that the technology disclosed herein can be practiced with modification and/or alteration, and that the disclosed technology is limited only by the claims of the present disclosure and equivalents thereof.

DETAILED DESCRIPTION

The technology disclosed herein is directed towards systems, methods and devices configured to more precisely tension the string(s) of a racket by applying a force to two or more string segments simultaneously; by more securely and precisely retaining tension within each string segment while subsequent segments are being tensioned; and by enabling more accurate adjustment of the force that is ultimately applied to individual string segments. A more detailed description of the technology disclosed herein, in accordance with one or more various embodiments, is provided below with reference to FIGS. 1-5. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
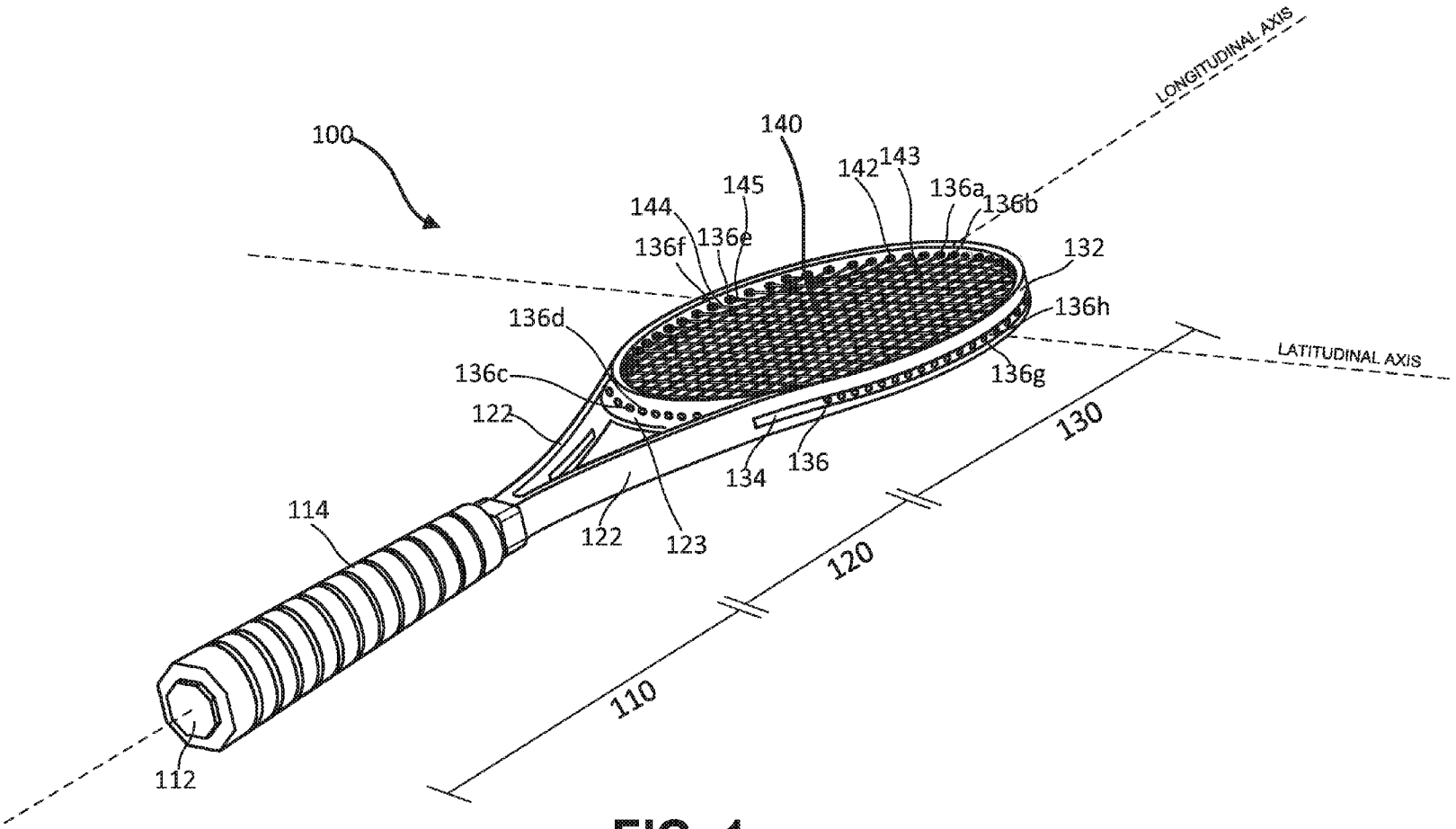
FIG. 1 PRIOR ART
FIG. 1 illustrates a perspective view of a standard tennis racket that may be strung and tensioned in accordance with embodiments of the present disclosure.

FIG. 1 illustrates a perspective view of an exemplary racket that may be strung and tensioned using embodiments of the present disclosure. The racket depicted in FIG. 1 is provided merely to aid in the discussion of the various embodiments disclosed herein, and is referred to throughout this disclosure to enable the reader to better understand the underlying context for deployment and operation of the various systems, methods and devices of the present technology. Nevertheless, it is noted that the present disclosure is not limited to embodiments configured to string and tension rackets that take on the design and structure depicted in FIG. 1. Instead, as one having ordinary skill in the art will immediately appreciate upon reading the contents of this disclosure, embodiments of the present disclosure may be readily adapted to accommodate nearly any racket design and structure without departing from the scope of the technology provided herein.

As depicted, racket 100 may be described as having three general sections: the handle 110, the throat 120, and the head 130. The handle includes a core 112 and a grip 114 wrapped around the core and configured for optimal friction when gripped by the hand of a user. Handle 100 is coupled to the head 130 via shaft 122, the area spanning between the handle 100 and the head 130 being referred to generally as the throat 120 of the racket. The shaft 122 of racket 100 is depicted in FIG. 1 as a Y-split shaft having two arms extending from the base of the shaft to the bridge 123 of the racket to create an aperture that is often referred to as an 'open-throat' configuration. Other configurations, not depicted, may include a single, unsplit shaft coupled directly to the head of the racket (a.k.a. a 'closed-throat' configuration). The head 130 of racket 100 is defined, in part, by a hoop-shaped rim 132; rim 132 generally being formed with a groove 134 along an outer portion, and also generally having a plurality of holes 136 (typically passing through the thickness of rim 132 along groove 134, as depicted) through which racket string(s) may be drawn and tensioned.

Though not explicitly depicted in FIG. 1, holes 136 within the rim 132 may be formed to receive a grommet to protect the racket string. Such grommets may further be situated on a bumper guard (not depicted) that can lay partially within and along groove 134 while the attached grommets run through holes 136 from the area outside hoop-shaped rim 132 to the area inside hoop-shaped rim 132. Though not necessary, when used the grommets and bumper guard provide additional protection to the strings and racket. Because grommets are hollowed components through which the string of the racket may also be disposed (like holes), for purposes of this disclosure the terms 'hole' and 'grommet' may be used interchangeably to refer generally to the aperture through which the racket string(s) are drawn and situated.

As illustrated, stringbed 140 is formed within the aperture created by hoop-shaped rim 132 of racket head 130. It should be noted that a racket may be strung with a single string, or multiple strings. In either case, some segments of the one or more strings typically run vertically (referred to as "mains"), and some segments of the one or more strings run horizontally (referred to as "cross-strings").

An example of a main is illustrated by string segment 142 spanning the distance between grommet 136*c* at bridge 123 and grommet 136*a* at the top of head 130. Another example of a main is illustrated by string segment 143 spanning the distance between grommet 136*d* at bridge 123 and grommet 136*b* at the top of head 130. The two mains just described (i.e. string segment 142 and 143) are the centermost mains in the depicted racket (with respect to the longitudinal axis of the racket), and are displaced the same distance from the longitudinal axis of the racket. Because, as depicted in FIG. 1, most racket heads are symmetrical (or nearly symmetrical) about the longitudinal axis of the head when laid flat, each main will have a complimentary main on the other side of the longitudinal axis at an equal distance from the longitudinal axis that will measure the same in length (or nearly the same length). As explained in the background section of this disclosure, each such set of mains is called a pair. So in FIG. 1, the main formed by string segment 142 and the main formed by string segment 143 are considered a pair of mains. Similarly, the main to the left of string segment 142 and to the right of string segment 143 are also considered a pair, and so on to the edge of the racket head.

An example of a cross-string is illustrated by string segment 144 spanning the distance between grommet 136*f* and grommet 136*g*. Another example of a cross-string is illustrated by string segment 145 spanning the distance between grommet 136*e* and grommet 136*h*. Although atypical, some racket heads are also symmetrical (or nearly symmetrical) about the latitudinal axis of the head when laid flat, each cross-string will often have a complimentary cross-string on the other side of the latitudinal axis at an equal distance from the latitudinal axis that will measure the same in length (or nearly the same length). Again, in such a configuration, each such set of cross-strings would be considered a pair. So in such a configuration, adopting the numerals of FIG. 1, the cross-string formed by string segment 144 and the cross-string formed by string segment 145 would be considered a pair of cross-strings. Similarly, the cross-string above string segment 145 and below string segment 144 would be considered a pair, and so on to the top and bottom the edges of the racket head.

It view of the above description, and as explained in the background section, it should be noted that any two string segments that have the same or nearly the same length (as measured between the receiving grommets) may be considered a 'pair' for purposes of this disclosure. It should further be noted that although the stringbed cross-hatch configuration depicted in FIG. 1 is common for many rackets, other configurations are preferred by some users, and may be implemented accordingly without departing from the scope of the technology disclosed herein.

As noted previously in this disclosure, a particularly important consideration for avid players is the uniformity and/or symmetry of the stringbed stiffness profile. The stiffness profile of a stringbed is the collection of stiffness measures at each location on the stringbed. Because players often use the front and back side of the racket stringbed interchangeably, ideally the racket stringbed profile should be as symmetrical as possible with respect to the longitudinal axis (and in some cases, the latitudinal axis as well). For example, as measured from the intersection of the longitudinal and latitudinal axes shown in FIG. 1, the stiffness displayed by the stringbed at a point measured X inches to the left of the longitudinal axis and Y inches up from the latitudinal axis should match the stiffness displayed by the stringbed at a point measured X inches to the right of the longitudinal axis and Y inches up from the latitudinal axis. Furthermore, albeit an uncommon design, in the case of a racket head that is also symmetric about the latitudinal axis, it may be desirable that the stiffness displayed by the stringbed at a point measured X inches to the left or right of the longitudinal axis and Y inches down from the latitudinal axis similarly match the stiffness measures displayed at the corresponding points described above. In either case, however, it is almost always desirable for stringbed 140 to have a stiffness profile that is symmetrical about the longitudinal axis.

As discussed, the stiffness measure at a particular location on stringbed 140 is based, in part, on an aggregate measure of the tension within each string segment (e.g. string segment 142, 143, 144, 145, etc.) affecting the particular location. Thus, as one of ordinary skill in the art will appreciate, in order to create a precisely tuned and symmetrically uniform stringbed, each pair of strings should display an equal tension at all times. Though many of today's string tensioning devices have been developed with the aim of achieving such an optimal stiffness/tension profile, each such device still suffers from one or more of the limitations discussed above. Some of the conventional devices include conventional drop-weight tensioners, electronic tensioners, and manual crank tensioners. For various reasons—discussed above and explained in more detail with reference to FIGS. 2A-2B below—these devices do not adequately achieve the objective of providing a uniform and/or symmetric stiffness profile in racket stringbeds.

Figure 2A:
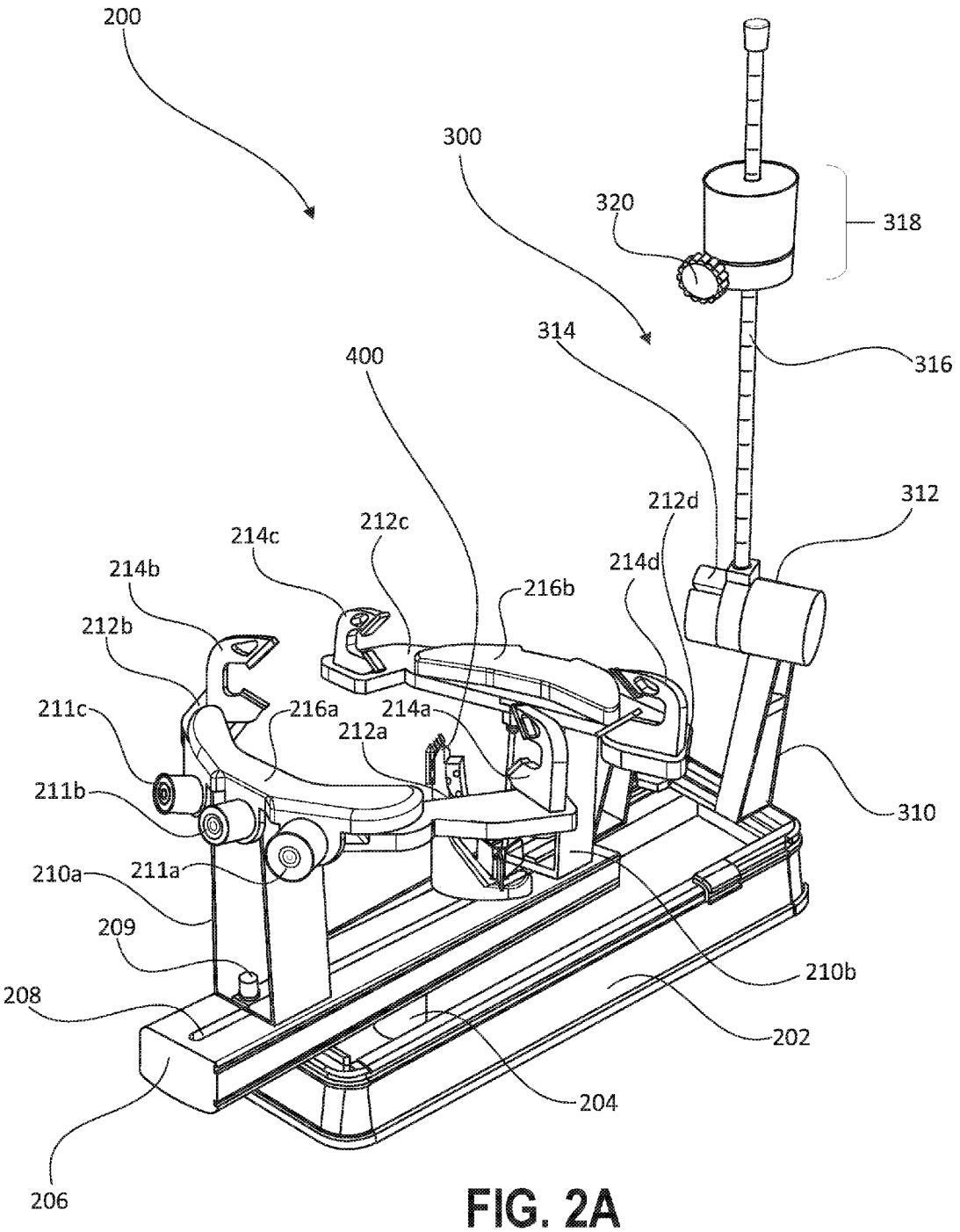
FIG. 2A PRIOR ART
FIG. 2A illustrates a perspective view of an example prior art drop-weight tensioning system with a stationary single-string clamp.

FIG. 2A is a perspective view of a prior art drop-weight tensioning device depicted without a racket positioned within the mounting module. As illustrated the tensioning device 200 includes a base 202 coupled to a turntable 206 via a rotatable bearing 204 such as a swivel bearing (details not explicitly depicted in FIG. 2A). The tensioning device 200 includes a racket mounting module including two mounting posts 210*a* and 210*b* (collectively, mounting posts 210) coupled to turntable 206 by a fastener 209 via channel 208. Fastener 209 may be loosened or tightened by a user to adjust the position of mounting post 210*a* to accommodate rackets of various sizes. Post 210*b* may be coupled to turntable 206 with a similar fastener, and may likewise be adjustable.

As depicted, the mounting posts 210*a* and 210*b* (collectively, mounting posts 210) are typically further coupled to or configured with one or more mounting arms 212*a*, 212*b*, 212*c*, 212*d* (collectively, mounting arms 212) which are further coupled to or configured with racket/shoulder clamps 214*a*, 214*b*, 214*c*, 214*d* (collectively, shoulder clamps 214). The mounting posts 210 are often further equipped with cushions 216*a*, 216*b* (collectively, cushions 216) that are adjustably coupled to or configured with the mounting posts 210 themselves, or to one or more of the mounting arms 212. The tensioner module 300 (sometimes referred to herein as simply, the 'tensioner'), is coupled to or configured with base 202 and includes a clamping mechanism designed to receive and securely grip racket string under a range of forces. The tensioner 300 depicted in FIG. 2A includes a cam style string gripper 314 (well known in the art). The tensioner 300 further includes a rod 316, the rod 316 and cam style string gripper 314 being rotatably coupled to post 310, e.g., via a rotatable bearing disposed in a housing 312 (not explicitly depicted in FIG. 2A). Weighted component 318 is configured with an aperture such that rod 316 may fit therethrough, with weighted component 318 being adjustably secured to rod 316 at a desired location along the length of rod 316 via star knob 320. Though not explicitly depicted in FIG. 2A, star knob 320 is typically coupled to a bolt or threaded shaft that may be tightened up against a portion of rod 316 to secure weighted component 318 into a desired position along the length of rod 316.

Figure 2B:
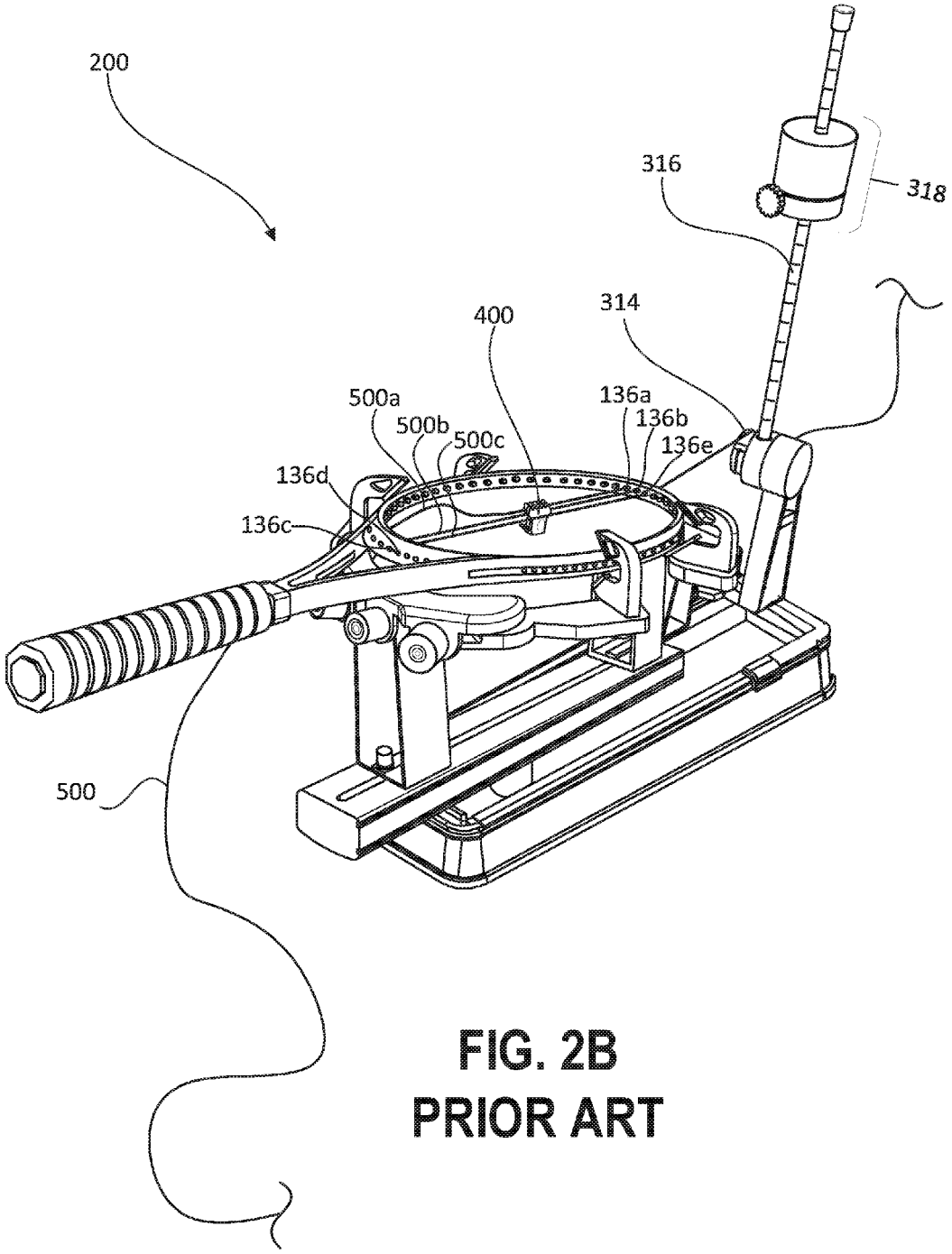
FIG. 2B PRIOR ART
FIG. 2B illustrates a perspective view of the example prior art drop-weight tensioning system of FIG. 2A (but here employing a floating clamp instead of a stationary clamp) with a partially strung racket mounted therein.

FIG. 2B illustrates the example prior art drop-weight tensioning system of FIG. 2A with a partially strung racket mounted therein. As may be seen from the figure, in operation an unstrung racket is secured within the racket mounting module/system by positionally adjusting one or more of the shoulder clamps 214, mounting arms 212, cushions 216, and mounting posts 210 via various fastening mechanisms known in the art (e.g. loosening and tightening fastener 209 to adjust the position of mounting post 210*a* relative to and along the length of turntable 206).

As shown, to begin the stringing process one end of string 500 may be drawn into the interior of the racket head (i.e. inside the aperture formed by the hoop-shaped rim) through grommet 136*a* while the other end of the string is drawn into the interior of the racket through grommet 136*b*, a portion of the string being looped circumferentially around the outer portion of rim 132 between grommets 136*a* and 136*b*. The end of the string drawn into the racket head through grommet 136*b* is then drawn out of the head through grommet 136*c*, then back into the head through grommet 136*d*, and finally back out of the racket through grommet 136*d* toward the tensioner. For purposes of FIG. 2B, the segment of string coming into the racket head through grommet 136*a* is referred to as segment 500*a*, the segment of string suspended between grommet 136*b* and 136*c* is referred to as segment 500*b* and the segment of string suspended between grommet 136*d* and 136*e* is referred to as segment 500*c*.

In operation, a clamp (floating dual-string clamp or stationary single-string clamp) is used to secure each string segment in place after being tensioned and while the next segment is being tensioned. FIG. 2B employs a floating dual-string clamp 400 for this purpose. As depicted, floating dual-string clamp 400 used to temporarily secure segment 500*a* to segment 500*b* while segment 500*c* is tensioned. Once segment 500*c* is tensioned, a second floating dual-string clamp (not depicted) may be used to secure segment 500*b* to segment 500*c* while the next segment is tensioned. Once clamped, the string 500 is then removed from the cam style string gripper 314 and fed back into the racket head through the next set of grommets. The racket is rotated on turntable 206 into an appropriate position with respect to the string gripper 314, and the next portion of the string proceeding out of the racket is again situated in the cam style string gripper 314 for tensioning. The drop-weight tensioning procedure described above is then applied to the next segment of string, and a floating dual-string clamp is again used to secure the newly tensioned segment to a previously tensioned segment. This process, or a variation thereof, continues until each main and each cross-string has been tensioned and the string is tied off.

With regard to tensioning in particular, as weighted component 318 is allowed to lower under its own weight the cam style string gripper 314 (gripping the string) rotates and applies a force to the string segment, thereby generating tension in the string segment. As one having ordinary skill in the art will recognize, the force applied to a given string segment is directly related to the torque generated at the rotational bearing caused by the force of gravity (or other force) pulling the weighted component 318 downward. The magnitude of torque is given by: $\tau=\|r\|\|F\|\cdot\sin\theta$, where $\tau$ is the magnitude of the torque vector; r is the distance between the axis of rotation and the point where the force is applied; F is the force being applied; and $\theta$ is the angle between the force vector and the lever arm (e.g. the rod 316). Thus, the force applied to the string is ultimately a function of the torque generated at the axis, and the torque generated at the axis being directly proportional to the weight component's 318 mass and its distance from the axis along rod 316. In other words, as the weight component 318 is moved further up rod 318, the resultant torque and ultimate force applied to the string segment increases. Likewise, as weight component 318 is moved further down rod 318 (i.e. closer to the cam style string gripper 314), the resultant torque and ultimate force applied to the string segment decreases. Accordingly, by adjusting the position of weight component 318 by hand a user may adjust the tension generated in a given string segment.

For brevity, the various limitations of conventional devices already discussed in the background section are not repeated here, but they are incorporated by reference here for purposes of the discussion. One of ordinary skill in the art will quickly recognize that each such limitation is apparent in the systems illustrated in FIGS. 2A and 2B, as well as in the other conventional devices currently available—such as electronic, crank, or spring-loaded tensioning systems. FIGS. 2A and 2B are simply provided to further illustrate a system that exemplifies these limitations for the reader.

Before proceeding to a discussion of the exemplary systems and devices depicted in FIGS. 3A-5, it is appropriate to note here that some embodiments of the present technology employ improved methodologies further disclosed herein. In particular, some aspects of the present disclosure include measuring tension within individual string segments—throughout the stringing process—using a frequency meter or vibration meter. The frequency of a string is proportional to its tension according to equation (1) below, $$f_n = \frac{n}{2L}\sqrt{T/\mu}, \tag{1}$$

where:

$f_n$ is the frequency of the $n^{th}$ harmonic,

L is the length of the vibrating part of the string,

T is the tension in the string; and

μ is the linear density of the string material, so the frequency measured in an individual string segment can inform the racket stringers understanding of the tension within the string segment. This presently disclosed methodology, although described below in the context of the systems and devices depicted in FIGS. 3A-5, may also be employed to enhance the precision of the stringing process in prior art devices. That is, a racket stringer using a conventional device may pluck the first segment of a pair of string segments and measure its pitch/frequency using a frequency meter. Then, as the racket stringer is tensioning the second segment of the pair, he or she may pluck and measure the second segment's pitch/frequency and make adjustments to the force being applied to the second segment until the frequency of the second segment matches the frequency measured for the first segment. Thus, instead of relying solely on the accuracy of their stringing devices (e.g. the position of the drop weight, the setting on their crank or electronic meter, etc.) to match the tension in string segments, racket stringers can more accurately measure the tension at a specific moment in time by using a frequency meter.

Of course, while the above method will improve the precision of the stringing process even when using conventional devices, it should be noted that the above noted drawbacks of the prior art devices will still significantly limit the precision of the stringing process. For instance, when using the above presented methodology to a prior art device, a racket stringer may expect that if the frequency in each segment of a pair matches, then the tension ultimately displayed by each segment of the pair will match. However, this conclusion will ultimately be flawed to some degree because it does not account for the fact that the rate of creep also changes with time for materials under tension. That is, even if the racket stringer plucks and precisely matches the frequencies of the first and second segments at a given moment, the tension displayed in the two segments will gradually begin to differ as time passes because each segment will be losing tension at a different rate. So because each of the two segments was actually tensioned at a different time, the rate at which the creep phenomenon is occurring will differ as between the two segments. However, as discussed below in connection with FIGS. 3A-5, employing the presently disclosed methodology in connection with the novel systems and devices of this disclosure will account for this difference and further improve accuracy and precision throughout the stringing process. Indeed, as one of ordinary skill in the art will appreciate, the systems, methods and devices of the present disclosure may be used to create a more precisely tuned and symmetrically uniform racket stringbed, where each pair of strings may be tensioned simultaneously to display an equal (or nearly equal) tension—as may be characterized by a unison pitch/frequency (at an $n^{th}$ harmonic).

Figure 3A:
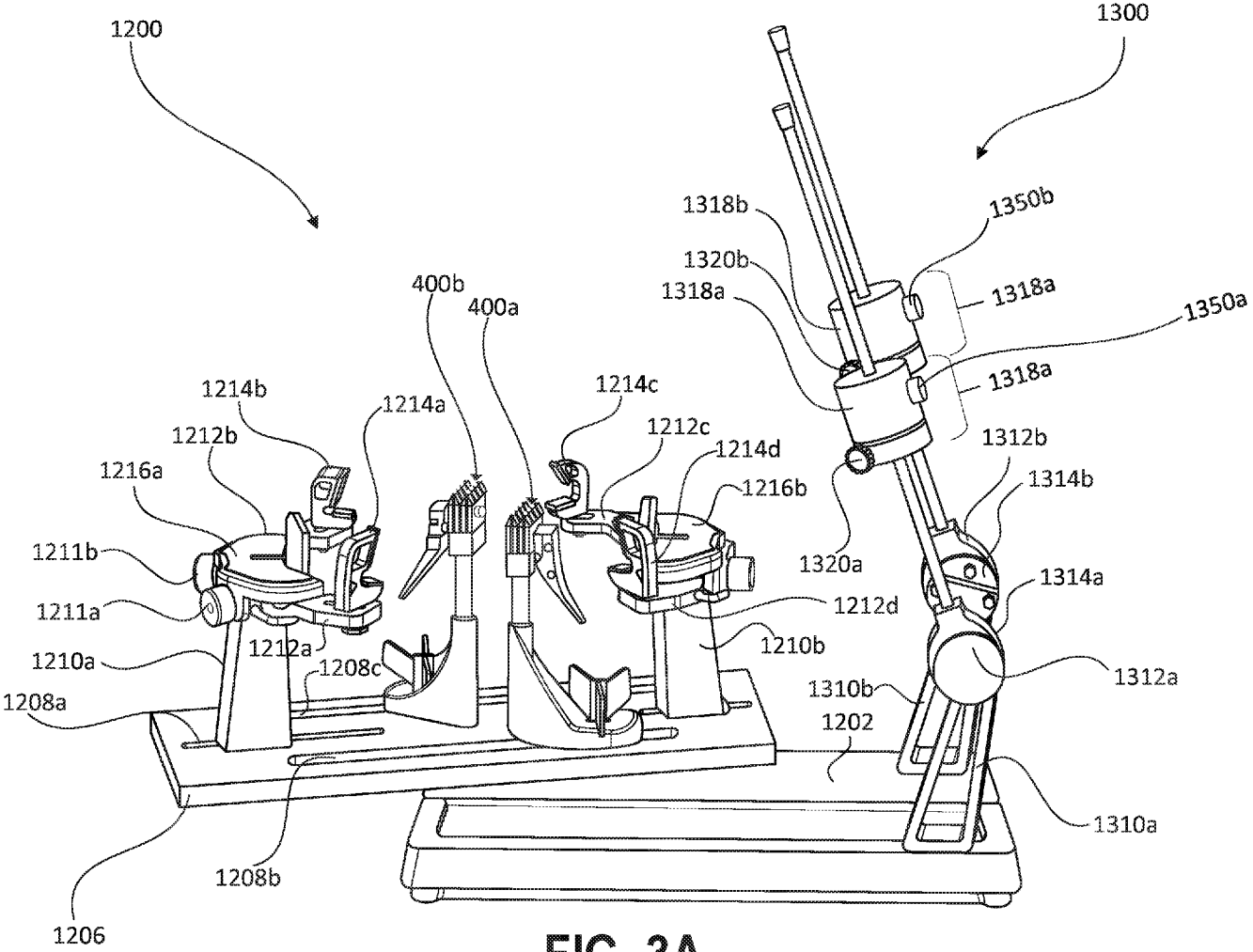
FIG. 3A illustrates a perspective view of a dual tension racket stringing system in accordance with some embodiments of the technology disclosed herein.

FIG. 3A is a perspective view of a dual-tension racket stringing system in accordance with some embodiments of the present technology. As will be appreciated by a person of ordinary skill in the art upon reading this disclosure, some embodiments of the present technology—including the embodiment depicted in FIG. 3A—enable two or more string segments (including string pairs) to be tensioned simultaneously to achieve unison pitch/frequency. Additionally, embodiments of the present technology enable the stringing process to proceed with enhanced speed and/or precision than available with conventional racket stringing devices.

As depicted in FIG. 3A, the dual-tension racket stringing system may include a base 1202, a turntable 1206 rotatably coupled with base 1202, and a mounting module/system adjustably coupled to the turntable and configured to receive and hold a racket. Though not required to implement the present technology, typically the mounting module/system will include one or more mounting posts 1210, mounting arms 1212, shoulder clamps 1214, and cushions 1216. As shown in FIG. 3A, embodiments of the present technology include a dual-tensioning component (or in some embodiments, two or more single tensioning components coupled to the stringing device in a manner that allows them to operate simultaneously). The dual-tensioning component may include an electronic tensioner, a manual crank tensioner, a spring loaded tensioner, a drop-weight tensioner, or any other tensioning component or combination thereof configured to apply force and create tension within more than one string segment at a time.

The embodiment represented in FIG. 3A depicts a dual-tensioning drop-weight tensioner 1300 configuration. As depicted, the dual-tensioning drop weight tensioner 1300 of FIG. 3A may include a first and second drop weight tensioning component coupled to base 1202 (via support posts 1310*a* and 1310*b*, respectively) and aligned in a manner that allows each to operate simultaneously during the tensioning process. Embodiments of the present technology include a first and second receptacle configured to releasably grip at least two strings—or at least two different portions of the same string—simultaneously. The first and second receptacles may be formed as part of a single assembly that is coupled to the base, or two or more assemblies that are individually coupled to the base (as depicted in FIG. 3A). Indeed, as one of ordinary skill in the art will appreciate, the dual-tensioning drop-weight tensioner of the present technology—and corresponding string receptacles thereof—may be formed as a single component coupled to the base (e.g. an electronic tensioner having two tensioning mechanisms configured to receive and apply force to two strings at the same time), or as multiple components, each aligned and configured to be coupled to the base (as illustrated by the two drop-weight tensioners coupled to base 1202 in FIG. 3A).

As illustrated, the first receptacle of dual-tensioning drop-weight tensioner 1300 is embodied in a first cam style string gripper 1314*a* coupled to a first rod 1316*a*. Both of the first cam style string gripper 1314*a* and the first rod 1316*a* are rotatably coupled to support post 1310*a* via a rotatable bearing (not explicitly depicted) disposed at least partially within housing 1312*a*. Similarly, the second receptacle of tensioner 1300 is embodied in a second cam style string gripper 1314*b* coupled to a second rod 1316*b*. Again, both of the second cam style string gripper 1314*b* and the second rod 1316*b* are rotatably coupled to support post 1310*b* via a rotatable bearing (not explicitly depicted) disposed at least partially within housing 1312*b*. The first and second rod 1316*a*, 1316*b* are further coupled to first and second weighted components 1318*a* and 1318*b* respectively. Weighted components 1318*a* and 1318*b* are each configured with an aperture substantially matching the outer radial profile of rods 1316*a* and 1316*b* such that the rods 1316*a* and 1316*b* may fit through such apertures. As illustrated, in some embodiments the weighted components 1318*a* and 1318*b* may be further equipped with star knobs 1320*a* and 1320*b* (or the like) which are coupled to a bolt or threaded shaft (or the like) that may be tightened against rods 1316*a* and 1316*b* to secure/lock weighted components 1318*a* and 1318*b* in a desired location along the length of rods 1316*a* and 1316*b*, respectively.

Equipped with two string receptacles, the dual-tensioning drop-weight tensioner 1300 of FIG. 3A enables a user to apply force to two segments of a racket string at the same time (enabling a racket stringer to better achieve unison frequency/pitch/tension in string pairs). In operation, once two string segments (e.g. a pair) have been tensioned in unison, they must both be secured in place by one or more clamps that can hold the two strings in place at the same time. As noted earlier, stationary clamps are generally more effective at holding tension in a given string segment than floating clamps. In either case, however, the most effective position for the clamp to be placed is inside the racket head in a position that is nearest to the tensioning component as possible (e.g. adjacent to the inside wall of the rim where the string segment leads out of the rim toward the tensioner).

Figure 3B:
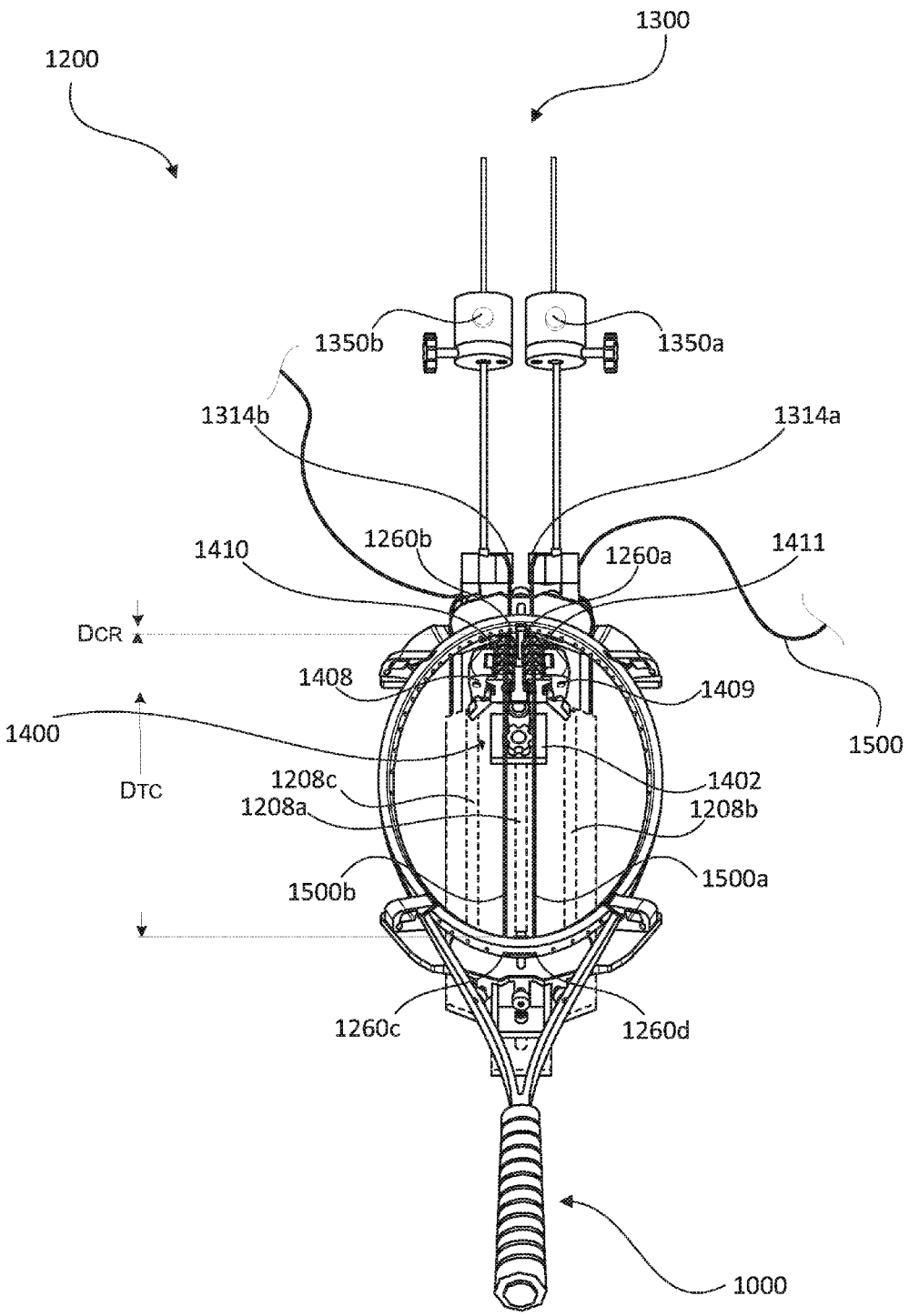
FIG. 3B illustrates an aerial view of a dual tension racket stringing system employing a stationary dual-string clamping device in accordance with some embodiments of the technology disclosed herein, and depicted with a partially strung racket mounted therein.

Because of the structure of conventional stationary single-string clamps, however, using two such clamps simultaneously is often undermined when attempting to secure/hold two neighboring string segments. In particular, for a typical racket, the neighboring strings are so close together that when two stationary single-string clamps are used to hold the tension in said neighboring strings, both stationary single-string clamps cannot be optimally positioned (i.e. both cannot be placed immediately adjacent to the inside wall of the rim because their base structures interfere with one another). That is, one of the clamps must be offset (away from the rim) in the longitudinal direction so that the other may take a position adjacent to the rim. This offset introduces error in the tensioning process, and makes it more difficult to ensure that neighboring string segment pairs (e.g. the two center-most mains) are tension matched (i.e. each being tensioned to display unison pitch/frequency). So while two conventional stationary single-string clamps may be used to hold two neighboring string segments in place, greater precision is enabled by employing the stationary dual-string clamp provided by the present disclosure for such a purpose. As shown in FIG. 3A, some embodiments of the dual-tensioning system 1200 include one or more stationary dual-string clamps, 400*a* and 400*b*, each being configured to grip and secure two string segments simultaneously when needed. FIG. 3B illustrates the scenario discussed above with respect to the central two mains (i.e. a pair of neighboring string segments), here depicting another embodiment of the stationary dual-string clamp of the present disclosure.

FIG. 3B illustrates an aerial view of an embodiment of the dual-tension racket stringing system of the present disclosure, here employing a stationary dual-string clamping device in accordance with some embodiments of the present technology, and being depicted with a racket mounted therein. As shown, the first string segment 1500*a* (suspended between grommet 1260*a* and grommet 1260*d*) and the second string segment 1500*b* (suspended between grommet 1260*b* and grommet 1260*c*) form a pair (i.e. they are of the same length). The dual-tension racket stringing system 1200 includes a stationary dual-string clamp 1400 including a base 1402 that may be coupled to the turntable, in this embodiment, via one or more of channel 1208*a*, 1208*b*, or 1208*c*. The stationary dual-string clamp 1400 also includes two sets of gripping jaws configured to grip and hold to string simultaneously. The gripping jaws of clamp 1400 are tightened and loosened as necessary via a quick release binder bolt 1408 and 1409, as depicted. However, it should be noted that any other mechanism known in the art for tightening and loosening the jaws of a clamp may be used. For example, ratchet tighteners, spring loaded tighteners, or the like may be implemented without departing from the scope of the present technology.

In operation, the racket string may be drawn through grommets 1260*a*, 1260*b*, 1260*c*, and 1260*d* as depicted. A portion of the string lies circumferentially around the outside of the racket rim between grommets 1260*c* and 1260*d*, while each end of the string is drawn out of grommets 1260*a* and 1260*b* and led into cam style string grippers 1314*a* and 1314*b* respectively. Once the weighted components are positioned in a desired location along the rods (as discussed previously), they are released and allowed to apply force to the two string segments (1500*a* and 1500*b*) simultaneously. Because each of the two segments is tensioned at the same time, a racket stringer may more precisely and accurately test the frequency/pitch displayed by each of the two segments, and thereby may more precisely achieve a matching tension within the two segments.

Once the stringer is satisfied that the tension in both segments is sufficiently matched, he or she may use stationary dual-string clamp 1400 to clamp both string segments before moving on to tension the next pair of strings. As may be seen from the figure, using the stationary dual-string clamp 1400 of the present disclosure allows both clamping jaws to be positioned adjacent to the inside wall the rim nearest to the tensioner. As noted previously, employing a stationary dual-string clamp minimizes the distance between the clamping jaws and inside wall of the rim, $D_{CR}$, for both sets of clamping jaws. Consequently, the portion of the string segment within which the tension is held, $D_{TC}$, is maximized for both segments, 1500*a* and 1500*b*, enabling more accurate and symmetrical retention of the tension created in the pair. Exemplary embodiments of stationary dual-string clamps of the present disclosure will be discussed in more detail with reference to FIGS. 4A and 4B.

Before moving on to a discussion of the stationary dual-string clamps, however, it should be noted that although the two string receptacles and force applying mechanism are depicted in FIGS. 3A-3B as embodied in a drop-weight tensioning configuration, the instant disclosure is not limited to such embodiments, and various other mechanism known in the art may be employed. Furthermore, although the first and second receptacles of FIG. 3A are depicted as being embodied in two separate assemblies or modules that are individually coupled to the base 1202, one of ordinary skill in the art will appreciate that the two receptacles may be formed as part of a single assembly or module that is coupled to the base without departing from the scope of the present technology. Indeed, and moreover, one of ordinary skill in the art will also quickly recognize that various configurations and modifications to the base, turntable, and mounting module/system may be implemented without departing from the scope of the present technology.

For example, instead of the dual-tensioning drop-weight tensioner configuration depicted in FIGS. 3A-3B, in some embodiments one or more of the first and second receptacles may be embodied in one or more electronic tensioners fixed/coupled to the base of the stringing device. In still further embodiments, one or more of the first and second receptacle may be embodied in a manual crank tensioner fixed/coupled to the base of the stringing device. Indeed, any other tensioning mechanism may be used to apply force to two or more strings (or two or more portions of the same string) via a first and a second receptacle without departing from the scope of the present disclosure.

Returning briefly now to a discussion of the mounting system/module, many racket mounting assemblies are currently available and commonly used in conventional devices. Any such mounting assemblies may be implemented in connection with the presently disclosed technology without departing from the scope of the present technology. For example, as depicted in FIG. 3A, in some embodiments the mounting system may comprise one or more mounting posts 1210*a*, 1210*b* (collectively, mounting posts 1210) coupled to one or more mounting arms 1212*a*, 1212*b*, 1212*c*, 1212*d* (collectively, mounting arms 1212) which are further coupled to racket head clamps or shoulder clamps 1214*a*, 1214*b*, 1214*c*, 1214*d* (collectively, shoulder clamps 1214). The mounting posts 1210*a*, 1210*b* may further be equipped with cushion 1216*a* or 1216*b* (collectively, cushions 1216) that are adjustably coupled to the mounting posts 1210, or to one or more of the mounting arms 1212, etc. Any one or more of the mounting posts 1210, mounting arms 1212, shoulder clamps 1214, and/or cushions 1216 may be adjusted via their respective coupling mechanisms to accommodate and grip various sized rackets. Indeed, many other modifications and configurations—even those employing different elements—may be used without departing from the scope of the present technology.

Figure 4A:
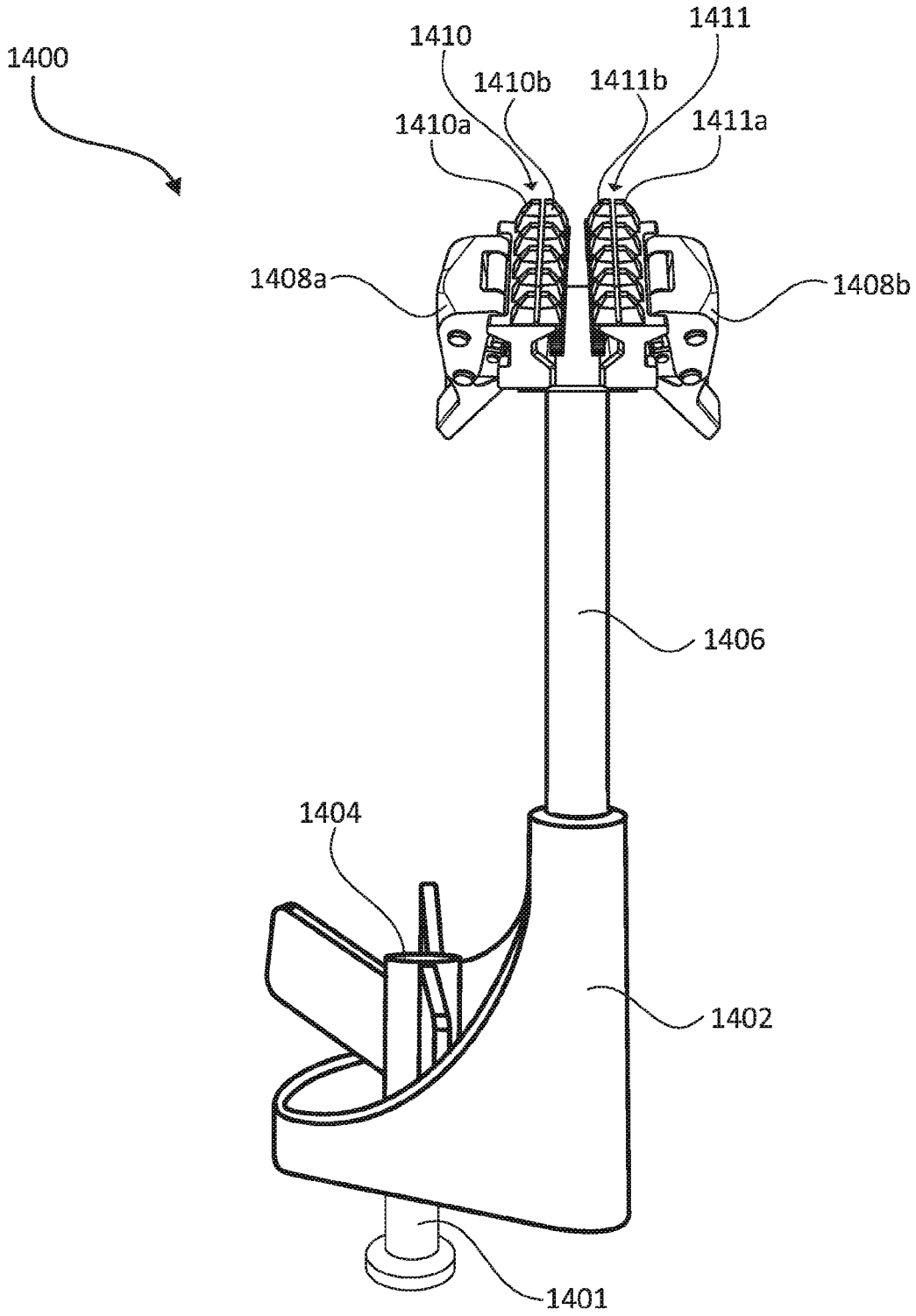
FIG. 4A illustrates a side view of a stationary dual-string clamping device in accordance with some embodiments of the technology disclosed herein.

FIG. 4A illustrates a magnified perspective view of an exemplary stationary dual-string clamp, such as that employed in FIG. 3B, in accordance with some embodiments of the present technology. As depicted, stationary dual string stationary clamp 1400 may include a base 1402, a coupler 1401, clamping extensions 1410*a*, 1410*b* and 1411*a* and 1411*b* (sometimes referred to herein as clamping jaws) and quick release binder bolts 1408*a* and 1408*b* (or the like) configured to enable a user to clamp and unclamp the racket string between said clamping extensions (i.e. loosen and tighten the clamping jaws upon a portion of racket string). Coupler 1401 and tightening mechanism 1404 adjustably couples base 1402 to turntable 1206 (e.g. through one or more of channel 1208*a*, 1208*b*, or 1208*c* of the turntable depicted in FIG. 3B). Although simplified in FIG. 4A, coupler 1401 may comprise a quick release crank bolt, a simple wing bolt, a butterfly nut and bolt combination, or other adjustably fastening mechanism commonly known in the art. In operation, once two neighboring string segments have been tensioned in unison in accordance with the present disclosure, stationary dual-string clamp 1400 may be adjusted and positioned in the desired location on the turntable, then locked into position (i.e. made stationary) relative to the turntable by engaging tightening mechanism 1404 and coupler 1401. As shown, two neighboring string segments may be positioned within the clamping jaws, e.g., in aperture 1410 between clamping extensions 1410*a* and 1410*b*, and in aperture 1411 between 1411*a* and 1411*b*. Once properly positioned, quick release binder bolts 1408*a* and 1408*b* may be employed to clamp and secure both tensioned segments in their tensioned position (using the structure of the turntable rather than a neighboring string as is the case when a floating clamp is employed).

It should be noted that while the embodiment of the exemplary dual string stationary clamp depicted in FIG. 4A includes four extensions 1410*a*, 1410*b*, 1411*a*, and 1411*b*, one of ordinary skill in the art will appreciate that variations on the clamping mechanism depicted may be employed to clamp and secure two strings or segments of string simultaneously. For example, in some embodiments three extensions may be employed to implement the dual string stationary clamp of the present disclosure (i.e. using a single clamping extension to serve as the inside clamping jaw for both mechanisms) and in other embodiments just one tightening mechanism 1403 may be employed to engage both sets of clamping jaws.

Figure 4B:
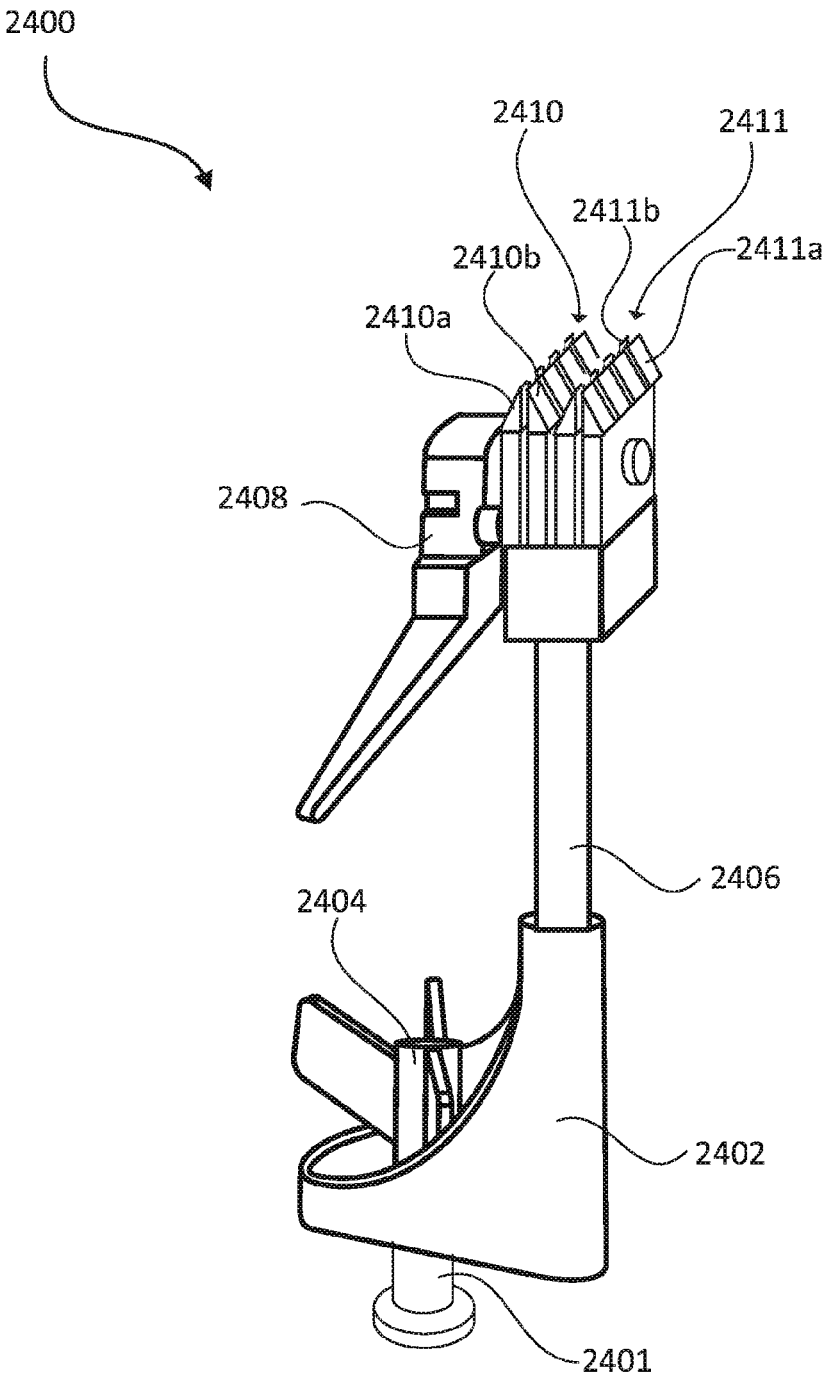
FIG. 4B illustrates a side view of another stationary dual-string clamping device in accordance with some embodiments of the technology disclosed herein.

FIG. 4B illustrates a magnified perspective view of another exemplary stationary dual-string clamp in accordance with some embodiments of the present technology. As depicted, stationary dual string stationary clamp 2400 may include a base 2402, a coupler 2401, clamping extensions 2410*a*, 2410*b* and 2411*a* and 2411*b* (sometimes referred to herein as clamping jaws) and a single quick release binder bolt 1408*a* (or the like) configured to enable a user to clamp and unclamp the racket string between said clamping extensions (i.e. loosen and tighten the clamping jaws upon a portion of racket string). Coupler 2401 and tightening mechanism 2404 adjustably couples base 2402 to turntable 1206 (e.g. through one or more of channel 1208*a*, 1208*b*, or 1208*c* of the turntable depicted in FIG. 3B). Although simplified in FIG. 4B, coupler 2401 may comprise a quick release crank bolt, a simple wing bolt, a butterfly nut and bolt combination, or other adjustably fastening mechanism commonly known in the art. In operation, once two neighboring string segments have been tensioned in unison in accordance with the present disclosure, stationary dual-string clamp 2400 may be adjusted and positioned in the desired location on the turntable, then locked into position (i.e. made stationary) relative to the turntable by engaging tightening mechanism 2404 and coupler 2401. As shown, two neighboring string segments may be simultaneously positioned within the clamping jaws, e.g., in aperture 2410 between clamping extensions 2410*a* and 2410*b*, and in aperture 2411 between 2411*a* and 2411*b*. Once properly positioned, quick release binder bolt 2408*a* and 2408*b* may be employed to clamp and secure both tensioned segments in their tensioned position (using the structure of the turntable rather than a neighboring string as is the case when a floating clamp is employed).

It should be noted that while the embodiment of the exemplary dual string stationary clamp depicted in FIG. 4B includes four extensions 2410*a*, 2410*b*, 1411*a*, and 2411*b*, one of ordinary skill in the art will appreciate that variations on the clamping mechanism depicted may be employed to clamp and secure two strings or segments of string simultaneously, as noted above with reference to FIG. 4A.

It should further be noted, with reference to FIGS. 4A and 4B, that the stationary dual-string clamps of the present technology not only enhance the precision with which two neighboring string segments may be secured and similarly tensioned, but also for added strength when securing other string segments as well. That is, when the stationary dual-string clamp of the present technology is used to secure non-neighboring string segments, it can also employ the second set of clamping jaws to grip a previously tensioned neighboring string—thereby utilizing both the structure of the turntable and the structure of a previously tensioned neighboring string to retain the tension in a given string segment. Thus, the stationary dual-string clamp of the present disclosure may be used in a manner that achieves the benefits of a conventional stationary clamp combined with the added benefits of a floating clamp, but avoiding drawbacks of using either one alone (all while providing the added functionality of clamping two strings at the same time).

Figure 5:
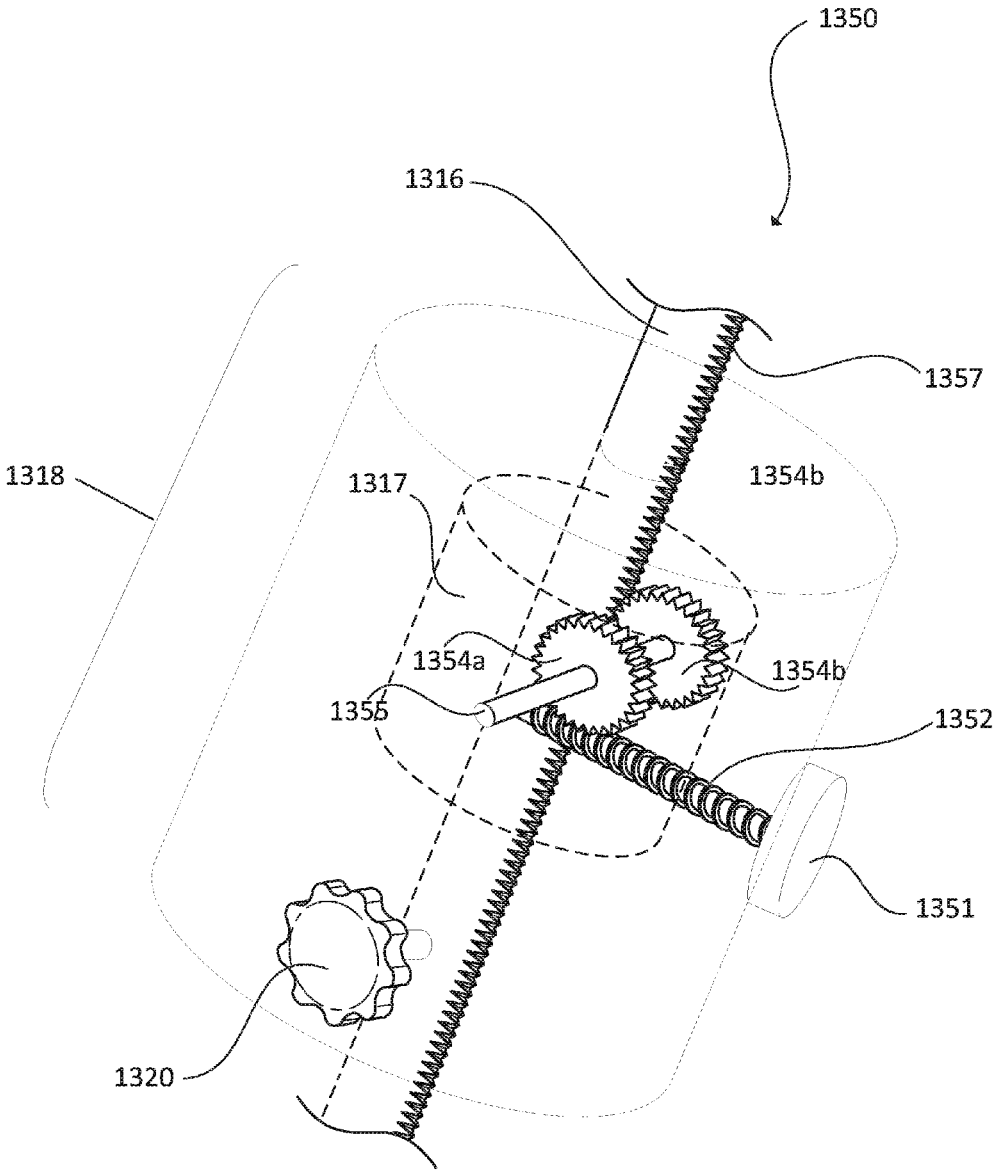
FIG. 5 illustrates a schematic side view of an exemplary drop-weight gear dial, including a rack and pinion adjustment apparatus for fine-tuning the position of a weighted component in a drop-weight tensioning system in accordance with some embodiments of the technology disclosed herein.

FIG. 5 illustrates a magnified perspective schematic of an exemplary drop-weight gear dial in accordance with some embodiments of the technology disclosed herein. As depicted, drop-weight gear dial 1350 includes a knob 1351 coupled to a threaded shaft 1352 that is communicatively coupled with (i.e. whose threads are configured to mesh with) the cogs of a first pinion gear 1354*a*. Pinion gear 1354*a* is further coupled to a second pinion gear 1354*b*, the cogs of the second pinion gear 1354*b* being configured to mesh with the cogs of rack 1357 embedded upon or coupled to rod 1316. As shown, one or more components of the drop-weight gear dial 1350 may be housed within an aperture formed in weighted component 1318. In operation, a user may rotate knob 1351 clockwise or counterclockwise to engage the rack and pinion components, and thereby cause the weighted component 1318 moved up and down rod 1316 in finer, more controlled increments that would otherwise be possible if moving the weighted component 1318 up and down the rod 1316 by hand alone. Once the weighted component 1318 is in the position desired by the racket stringer, a user may tighten the weight in place using star knob 1320 (e.g. in a similar manner as described previously with respect to star knob 320). Moreover, if a racket stringer wishes to move the weight just slightly while a particular segment is being tensioned, e.g., to achieve a slightly higher or lower tension, the drop-weight gear dial enables a user to do so (i.e. by loosening star knob 1320 and adjusting the position of the weighted component 1318 by rotating knob 1351 while the string is under tension) with greater precision than would otherwise be possible with conventional drop-weight tensioning systems. Such embodiments of the present technology allow a user to more precisely tension the strings of their racket to display a desirable tension, and permit the user to adjust the tension/frequency/pitch displayed by a particular string segment with finer granularity.

As one of ordinary skill in the art will appreciate, variants of the adjustment mechanism may be employed without departing from the scope of the present disclosure. For instance, in some embodiments the shaft may be configured with cogs that mesh directly with the cogs of the rack. In other embodiments only a single pinion gear may be used. And in still further embodiments, a series of gears or cogwheels may be employed and engaged by knob 1351 to further refine the precision of the adjustments that may be made by a user. Furthermore, although a rack and pinion type adjustment mechanism has been depicted in FIG. 5, the present technology is not limited to such embodiments. Indeed, upon reading this disclosure one of ordinary skill in the art will appreciate that many other adjustment mechanisms (e.g. utilizing one or more of a threaded worm gear, spur gear, bevel/miter gear, etc.) may be employed without departing from the scope of the present technology. Indeed, the present disclosure extends to any such adjustment mechanisms that enable a user to make more fine-tuned adjustments in the position of the weighted component 1318 along rod 1316 than he or she may otherwise make by hand alone.

As described, embodiments of the present disclosure enable two or more string segments to be tensioned at the same time, with the particular embodiments depicted in FIGS. 3A-3B illustrating the dual tensioning technology employed via a dual drop-weight tensioner 1300, utilizing a stationary dual string clamp 1400, and further utilizing a drop-weight gear dials 1350*a* and 1350*b*. As discussed above, the technology of the present disclosure enables two tensioning operations to occur simultaneously during the stringing process, and allows the overall stringing and tensioning processes to be completed more precisely, accurately, symmetrically and quickly.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether including control logic or other structural components, can be combined in a single package or separately maintained and can further be distributed in multiple groupings or packages.

Additionally, the various embodiments set forth herein are described in terms of exemplary diagrams and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

We claim:

1. A racket string tensioning system comprising:

a base;

a turntable rotatably coupled with the base;

a mounting support adjustably coupled with the turntable, the mounting support configured to secure a racket;

a tensioner coupled with the base, the tensioner comprising:

a first receptacle configured to releasably grip a first string portion;

a second receptacle configured to releasably grip a second string portion;

wherein the tensioner is operable to generate tension in the first and second string portions simultaneously by applying force to:

the first string portion via the first receptacle; and the second string portion via the second receptacle.

2. The racket string tensioning system of claim 1, wherein the tensioner is a drop weight tensioner comprising:

a support coupled to the base;

wherein the first receptacle is rotatably coupled to the support; and wherein the second receptacle is rotatably coupled to the support;

a first rod coupled and rotatable with the first receptacle, a first drop-weight adjustably coupled with the first rod such that the position of the first drop-weight along the length of the first rod may be adjusted by a user;

a second rod coupled and rotatable with the second receptacle;

a second drop-weight adjustably coupled with the first rod such that the position of the second drop-weight along the length of the second rod may be adjusted by a user.

3. The racket string tensioning system of claim 2, wherein at least one of the first receptacle and the second receptacle is a cam string gripper.

4. The racket string tensioning system of claim 1, wherein the tensioner is a drop weight tensioner comprising:

a first support coupled to the base, wherein the first receptacle is rotatably coupled to the first support;

a second support coupled to the base, wherein the second receptacle is rotatably coupled to the second support;

a first rod coupled and rotatable with the first receptacle, a first weighted component adjustably coupled with the first rod such that the position of the first weighted component along the length of the first rod may be adjusted by a user;

a second rod coupled and rotatable with the second receptacle;

a second weighted component adjustably coupled with the first rod such that the position of the second weighted component along the length of the second rod may be adjusted by a user.

5. The racket string tensioning system of claim 1, further comprising a floating string clamp configured to simultaneously clamp two separate portions of the string and temporarily fix their position relative to one another.

6. The racket string tensioning system of claim 1, further comprising a stationary dual-string clamp coupled to the turntable, wherein the stationary dual-string clamp is configured to clamp two separate portions of the string simultaneously.

7. The racket string tensioning system of claim 1, further comprising a gear dial operatively coupled to the drop-weight and the rod, wherein rotating the gear dial causes the drop-weight to move relative to the rod.

8. The racket string tensioning system of claim 1, wherein the racket mounting support comprises:

two mounting posts positioned at substantially opposite ends of the turntable, the proximal end of each mounting post adjustably coupled to the turntable via one or more adjustable fasteners extending through a portion of an aperture formed in the turntable;

wherein the distal end of each of the two mounting posts is configured to grip a portion of a racket, temporarily securing the racket in a fixed position relative to the tensioner.

9. The racket string tensioning system of claim 8, wherein the racket support further comprises:

a third shoulder clamp adjustably coupled to the first mounting plate;

a fourth shoulder clamp adjustably coupled to the second mounting plate.

10. The racket string tensioning system of claim 1, wherein the racket support comprises:

a first mounting post adjustably coupled to the turntable, a first mounting plate adjustably coupled to the first mounting post;

a first shoulder clamp adjustably coupled to the first mounting plate.

11. The racket string tensioning system of claim 10, wherein the racket support further comprises:

a second mounting post adjustably coupled to the turntable, a second mounting plate adjustably coupled to the second mounting post;

a second shoulder clamp adjustably coupled to the second mounting plate.

12. The racket string tensioning system of claim 1, wherein at least one of the first receptacle and the second receptacle is a linear ball bearing string gripper.

13. The racket string tensioning system of claim 12, wherein the electronic tensioner employs electronic frequency meters to determine the amount of tension generated in a string segment.

14. The racket string tensioning system of claim 1, wherein the tensioner is an electronic tensioner.

15. The racket string tensioning system of claim 1, wherein the tensioner is a manual crank tensioner.

16. A method of tensioning the strings of a racket, the method comprising:

securing a racket to a racket mounting apparatus such that the head of the racket maintains substantially horizontal orientation at a fixed distance from a tensioner having at least two receptacles;

threading an end of a string through a first pair of grommets of the racket;

threading an end of the string through a second pair grommet of the racket;

securing in a first receptacle of the tensioner a first portion of the string extending out of the head of the racket through a grommet;

securing in a second receptacle of the tensioner a second portion of the string extending out of the head of the racket through a grommet;

applying force to the first portion of string and the second portion of string simultaneously.

17. The method of claim 16, further comprising: plucking one or more of said string through the first pair of grommets and said string through the second pair of grommets, and measuring frequency therein using a frequency meter.

18. The method of claim 16, wherein at least one of the first receptacle and the second receptacle is a cam string gripper.

19. The method of claim 16, wherein at least one of the first receptacle and the second receptacle is a linear ball bearing string gripper.

20. The method of claim 16, wherein the tensioner comprises at least two positionally adjustable weighted components coupled to at least two rods rotatably coupled to a base, the base being further coupled to the racket mounting apparatus.

21. The method of claim 16, wherein the tensioner is an electronic tensioner employing at least one electronic frequency meter.

* * * * *